United States Patent [19]

York

[11] Patent Number: 4,779,681

[45] Date of Patent: Oct. 25, 1988

[54] PACKER FOR OIL OR GAS WELL WITH LATERAL PASSAGE THERETHROUGH AND METHOD OF FRACTURING WELL

[76] Inventor: Michael York, P.O. Box 236, Youngsville, Pa. 16371

[21] Appl. No.: 62,855

[22] Filed: Jun. 16, 1987

[51] Int. Cl.[4] ..... E21B 43/26

[52] U.S. Cl. ..... 166/308; 166/100; 166/118; 166/177; 166/185

[58] Field of Search ..... 166/100, 118, 177, 185, 166/186, 222, 298, 308, 387

[56] References Cited

U.S. PATENT DOCUMENTS

| | | | |
|---|---|---|---|
| 2,301,624 | 11/1942 | Holt | 166/100 X |
| 2,629,447 | 2/1953 | Nebolsine | 166/312 X |
| 2,716,454 | 8/1955 | Abendroth . | |
| 2,776,014 | 1/1957 | Lee et al. | 166/177 |

FOREIGN PATENT DOCUMENTS

| | | | |
|---|---|---|---|
| 1301406 | 7/1961 | France | 166/187 |

*Primary Examiner*—Jerome W. Massie
*Assistant Examiner*—William P. Neuder
*Attorney, Agent, or Firm*—Baldwin, Egan & Fetzer

[57] ABSTRACT

A pressure packer assembly adapted for positioning in a bore of a gas or oil well, and having a compressible sealing element which when actuated prevents fluid flow from below the compressed sealing element, with the packer assembly including the sealing element, having a lateral opening therethrough so that fracturing fluid passes through such lateral opening in the packer assembly into fracturing contact with the well bore. A notch gun coacting with the packer is also disclosed. A method is also disclosed of fracturing the formation traversed by the well, and comprising positioning the packer assembly in the well at a selected zone and actuating the packer sealing element into pressurized engagement with the interior periphery of the well, and then pumping fracturing liquid via the lateral opening in the packer assembly directly into fracturing engagement with the confronting area of the zone of the formation, to fracture the formation at such zone commencing at the opening and extending outwardly therefrom. The packer assembly can be rotated about its lengthwise axis relative to the fractured portion of the zone, whereby the opening in the packer assembly faces a different section of the periphery of the well to provide for further fracturing of the formation commencing at the opening and extending outwardly therefrom in a direction different from the direction of fracturing of the first fracturing location.

21 Claims, 4 Drawing Sheets

PACKER FOR OIL OR GAS WELL WITH LATERAL PASSAGE THERETHROUGH AND METHOD OF FRACTURING WELL

This invention relates in general to well apparatus of the type having expandable gripping means, such as slips, for anchoring a conduit in a bore hole and for setting a packer assembly, and more particularly relates to a packer assembly which includes a laterally extending opening through the flexible sealing element thereof, for applying pressurized fracturing fluid from a source thereof to the packer assembly and then in a direction laterally thereof into fracturing contact with a selected zone of the formation traversed by the well. The invention also provides a notch gun adapted for guided coaction with the packer assembly and a novel method of fracturing a well whereby more precise control over the application of fracturing liquid to the periphery of the inner surface of the well, is accomplished.

BACKGROUND OF THE INVENTION

Heretofore, in the fracturing of relatively shallow wells (e.g. wells up to a depth of approximately 2500 feet) it has been common practice to position a packer apparatus in the well, set the packer apparatus, and then apply the fracturing fluid down through the attached tubing or piping and through the packer assembly vertically downwardly, whereby the fracturing fluid is then applied outwardly to the formation via the lower end of the packer assembly. In such procedure, each zone of the well bore being fractured in the formation must generally be isolated, and in order to accomplish this, gravel is generally pumped or poured down the well bore to act as an artificial bottom to isolate the zone being worked on from the zones traversing the well bore therebelow. The fracturing fluid, which may be water, delivers the pressure from the upper surface to the intended zone in the well bore, and enables the fracturing of the formation. When the formation breaks, water with a mixture of grit is usually pumped into the fracture to hold the fracture "open" thus facilitating and allowing any gas and oil to seep from the fracture into the well bore; thereafter more gravel is pumped out the piping or tubing to lower the artificial bottom while the packer is deactuated and moved downwardly in the well bore to a new lower zone, and then the packer is reset in conjunction with the lowering of the artificial bottom, for fracturing the new zone in the well bore.

This process is continued until the well bore has been fractured and the gas and oil in the fractured zones can then seep into the well bore, the gravel forming the artificial bottoms having been removed by pumping or sucking it out.

While fracturing laterally through a pipe and intermediate vertically spaced packer sealing elements is known, as for instance from U.S. Pat. No. 2,716,454 to G. F. Abendroth dated Aug. 20, 1955 and entitled Fracturing Formations Selectively, heretofore to applicant's knowledge no one has controlled the application of fracturing fluid to a zone of a formation utilizing a lateral opening in the sealing member of a packer.

SUMMARY OF THE INVENTION

The present invention provides a novel lower packer assembly which can be connected to or disconnected from the usual upper portion of a pressure packer, and wherein the lower packer assembly includes opening means extending laterally through the packer and communicating with the pipe string, so that fracturing fluid can be passed downwardly into the packer and then laterally outwardly into fracturing engagement with the confronting periphery of the well bore and in a manner whereby fracturing fluid can be expeditiously directionally controlled for fracturing the formation.

The invention also provides a novel method of fracturing a formation traversed by the well utilizing a packer with a lateral fracturing fluid opening in the sealing member thereof, by setting the packer at a particular zone in the formation and then applying fracturing fluid via the opening to the confronting well bore surface at said opening to cause a directional fracturing of the zone commencing at the lateral opening in the sealing member of the packer and extending generally radially outwardly therefrom. The packer may then be deactuated, rotated in the well bore, reset, and then fracturing fluid can be again applied via the opening laterally into engagement with a confronting area of the zone to fracture the formation at the zone commencing at the opening, and extending outwardly therefrom in a direction different from the direction of the first mentioned fracturing.

Accordingly, an object of the invention is to provide a novel pressure packer assembly for use in a well bore whereby directional notching and/or fracturing of a formation can be expeditiously accomplished.

A still further objection of the invention is to provide a pressure packer of the above mentioned type which can be utilized with the upper portion of a conventional slip type packer assembly, for applying fracturing fluid to a well bore at a limited area of the formation, and which can be rapidly and expeditiously attached to and removed from the conventional upper section of a slip type packer assembly.

A still further object of the invention is to provide a novel pressure packer for use in a well bore which includes means for guiding and positioning a notch gun therein for applying notching fluid laterally of the packer assembly toward the confronting well bore periphery, to enable notching of the well bore periphery prior to application of fracturing fluid thereto to cause fracturing of the well bore formation traversed by the well bore.

A still further object of the invention is to provide a novel pressure packer assembly which is relatively simple in construction and yet is operable to effectively and efficiently apply fracturing fluid laterally of the packer sealing element into fracturing contact with a limited zone of the formation, to cause fracturing thereof, and wherein the packer assembly can be deactivated and then rotated into a new directional position, to cause a fracturing of the well bore at a location angularly disposed with respect to the location of initial fracturing in the zone.

Another object of the invention is to provide a novel method of fracturing a formation traversed by a well bore by utilizing the application of a fracturing fluid passing laterally of the sealing element of the packer whereby the fracturing fluid is directionally applied via the lateral opening in the sealing element, and into engagement with a limited area of a zone of the traversed formation, to fracture the formation at said zone and extending generally radially outwardly therefrom.

A still further object of the invention is to provide a method of the aforementioned type which includes rotating of the packer and then resetting it in the well bore to cause directional fracturing of the zone at a rotative angle different from the first mentioned direction of fracturing, whereby the well bore can be fractured about its periphery in particular zone areas to increase gas and oil flow from the fracture of the zone into the well bore.

A still further object of the invention is to provide a method whereby less space is required between the zones being fractured in a well bore, thereby enabling the application of more fractures in the well bore in a particular zone, to increase the flow of oil and gas from the fractured zones into the well bore.

Other objects and advantages of the invention will be apparent from the following description taken in conjunction with the accompanying drawings wherein:

DESCRIPTION OF THE PREFERRED EMBODIMENT

Figure 1:
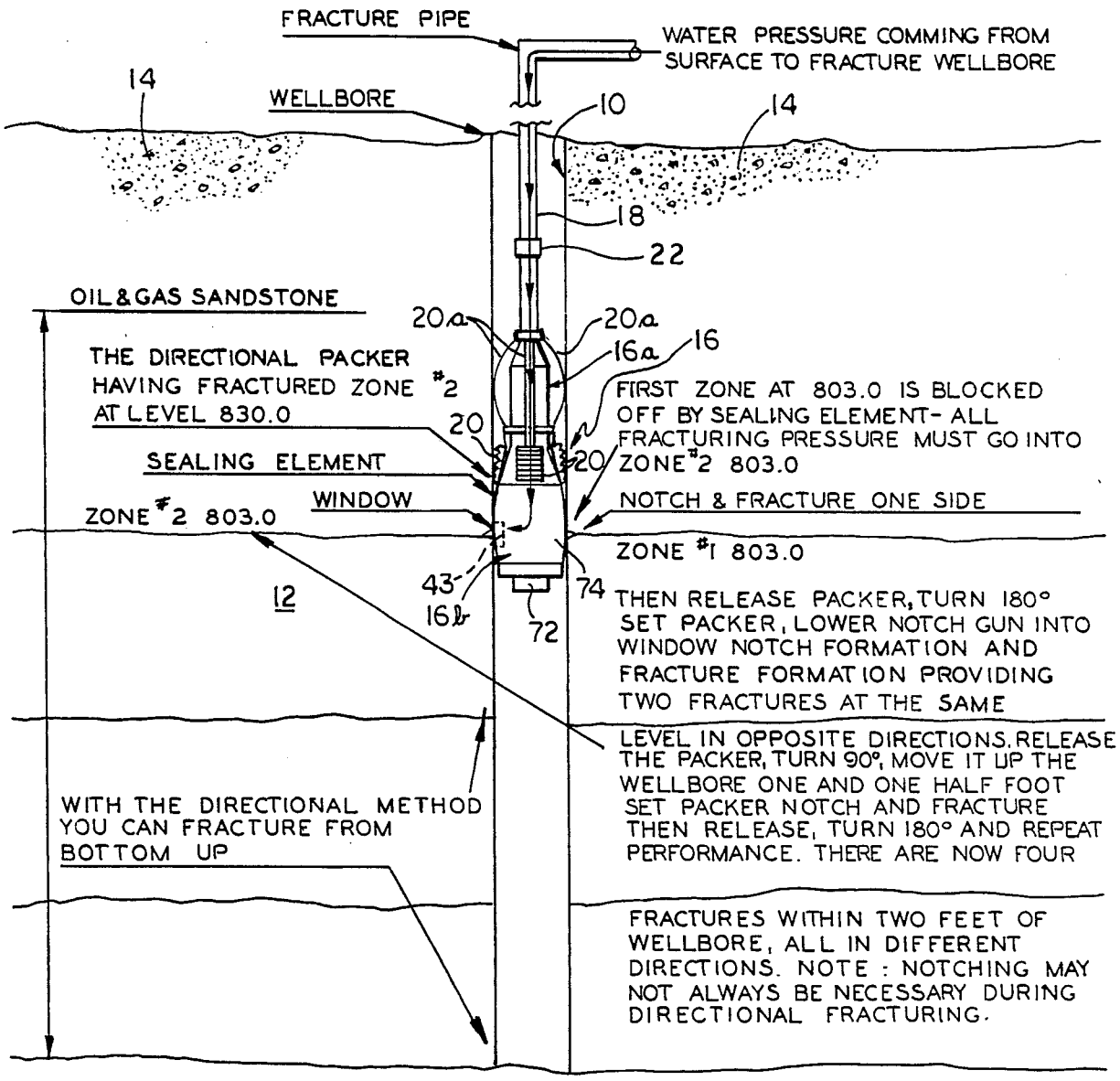
FIG. 1 is a generally diagrammatic, sectional elevational illustration of a packer assembly embodying the invention and positioned in the well bore for applying fracturing fluid via the sealing element of the packer through a lateral opening therein and into fracturing engagement with the interior surface of the well bore at a selected zone.

Referring now again to the drawings, there is illustrated a well or bore hole 10 which has been drilled or formed into a producing formation, such as an oil formation 12, and which may be covered by overburden 14. The bore hole or well 10 with which the present invention is particularly adapted for use is of the relatively shallow type (e.g. up to a depth of approximately 2,500 feet) and is uncased at least in the area in which the packer tool 16 is adapted to operate for applying fracturing fluid to selected zones in the formation 12.

A pipe or conduit string 18 is attached in conventional manner, to the packer tool 16 which in the embodiment illustrated comprises a conventional upper packer section **16*a* to which the pipe string 18 is attached, and a lower packer section 16*b*** with which the present invention is particularly concerned.

The upper packer assembly section **16*a* may be and preferably is of the general type presently commercially available from the Butler Larkin Company located in Wellsville, N.Y., and known as their type B Pressure Packer, and which includes slip mechanism 20 of conventional well known type, and also including the usual rings, back off bushing, clutch ring, cage with J-slot, and upper mandrel 21, the latter being axially movable for actuation of the lower packer section 16*b*** in generally known manner and as well be hereinafter described in detail.

Slips 20 and associated slip spring **20*a* are operative in the conventional manner to set the packer in the well bore, preparatory to applying fracturing fluid to the well bore. Thus slip members 20 are adapted to move outwardly upon actuation of the packer, and into gripping coaction with the periphery of the well bore to set the packer in the well bore, and as shown for instance in FIGS. 1 and 5. Upper mandrel 21 may be coupled by any suitable means such as for instance by threaded collar 22 to the pipe string 18**.

Figure 6:
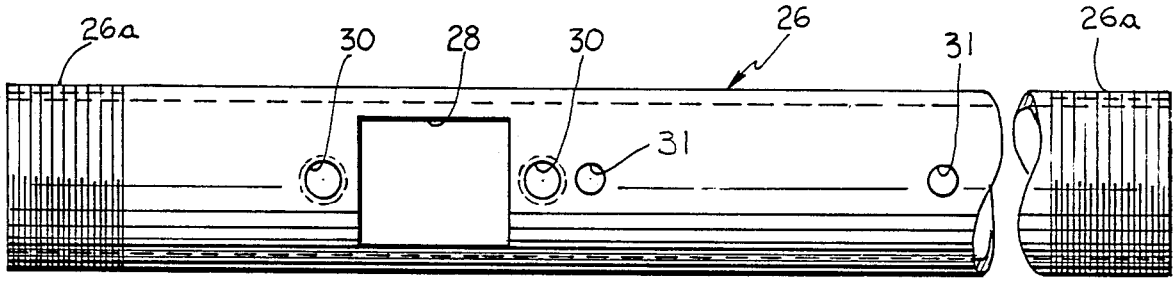
FIG. 6 is a broken, front elevational view of the lower mandrel of the packer of FIGS. 1–5, with such mandrel having been rotated 90 degrees from its usual operative vertical position in a well bore
Figure 7:
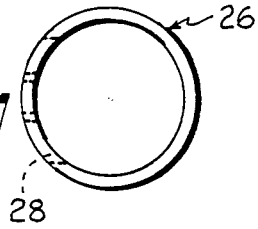
FIG. 7 is an end elevational view of the lower mandrel of FIG. 6 taken from the right hand end thereof.

The lower packer section 16*b* with which the present invention is particularly concerned, comprises in the embodiment illustrated, a lower mandrel member 26 (FIGS. 4 and 6) which in the embodiment illustrated is, preferably threaded, as at 26*a*, at both ends thereof, and which in accordance with the invention, has a lateral opening or window 28 formed in the defining side of the wall thereof. Threaded openings 30 may be provided on either side of the opening or window 28, and spaced openings 31 spaced lengthwise of the mandrel may also be provided, for reasons to be hereinafter set forth.

Figure 8:
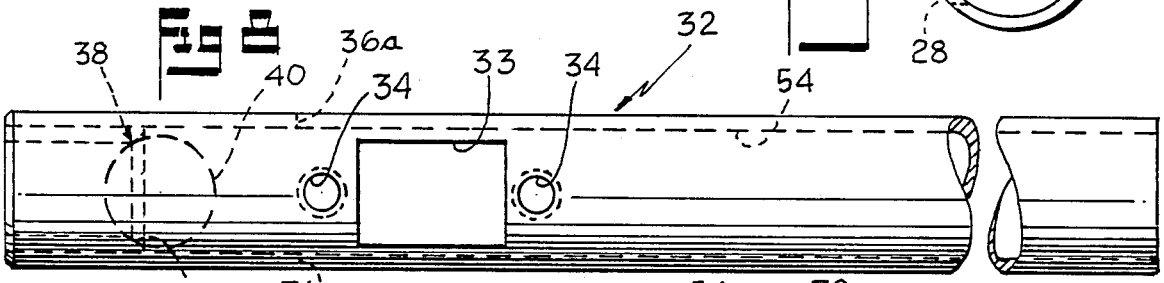
FIG. 8 is a broken, front elevational view of the inner mandrel member of the packer of FIGS. 1–5, such inner mandrel being adapted to be received in telescoped relation in the lower mandrel member of FIG. 6.

An inner mandrel member 32 (FIGS. 4, 8 and 9) is also provided, with such inner mandrel likewise provided with an opening or window 33 formed therein. The window in the inner mandrel 32 is preferably slightly less in width than the window 28 in the lower mandrel 26, but the length or height of such window 33 is preferably approximately the same in both lower and inner mandrels. Preferably, threaded openings 34 are provided on either side of window or opening 33 in the inner mandrel, for a reason to be hereinafter set forth.

Figure 9:
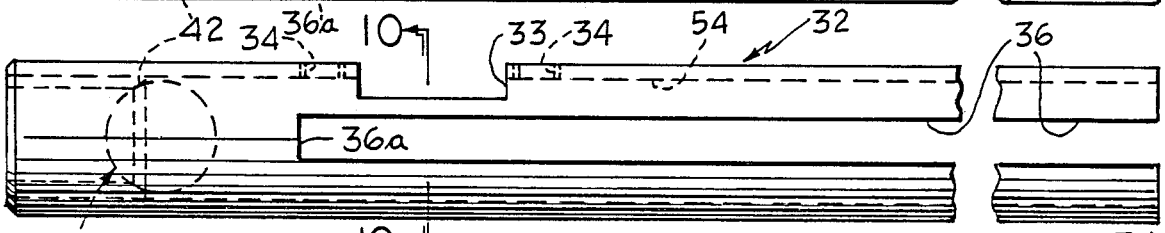
FIG. 9 is a broken, side elevational view of the inner mandrel of FIG. 7 particularly showing the slots therein for guiding an associated notch gun.
Figure 11:
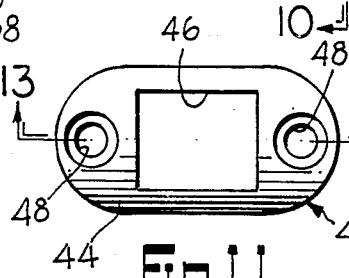
FIG. 11 is a front elevational view of a window member adapted for assembly with the lower mandrel and the inner mandrel of respectively FIG. 6 and FIG. 8, with such window member having been rotated 90 degrees from its usual operative position on the lower mandrel.
Figure 12:
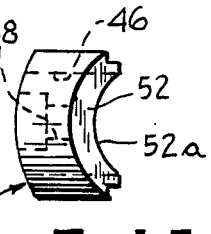
FIG. 12 is an end elevational view of the window member of FIG. 11 taken from the right hand thereof.
Figure 10:
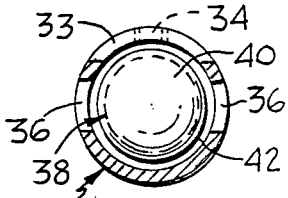
FIG. 10 is a sectional view taken generally along the plane of line 10—10 of FIG. 9, looking in the direction of the arrows, and illustrating in particular a ball type check valve disposed at the lower end of the inner mandrel.
Figure 13:
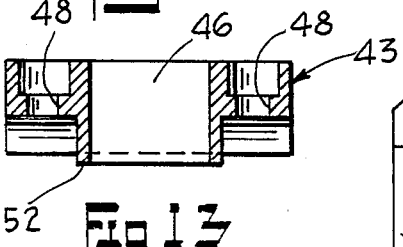
FIG. 13 is a sectional view taken generally along the plane of line 13—13 of FIG. 11 looking in the direction of the arrows.

Referring particularly to FIG. 9, it will be seen that the inner mandrel is provided with slots 36 in the side wall thereof, extending lengthwise from one end (the upper end) of the mandrel toward the other end (the lower end), but terminating short thereof. Slots 36 are for a purpose to be hereinafter described.

The lower end of inner mandrel 32 is provided with a check valve 38 comprising a preferably heat treated and case hardened or nitrided ball member 40 adapted for engagement with a heat treated and case hardened seat 42 in such lower end of the inner mandrel 32. Ball 40 could be formed of other suitable material rather than metal, if so desired. The purpose of check valve 38 will be hereinafter set forth.

A window element 43 (FIGS. 11, 12, 13 and 14) may be provided, with such window element being preferably heat treated and nitrided to give it substantial wear characteristics. Window element 43 comprises a body portion 44 which is provided with a passageway or opening 46 extending therethrough and with through passageways 48 disposed on either side of opening 46, with passageways 48 being adapted for alignment with the respective of aforementioned openings 34 in the inner mandrel 32 and the respective of openings 30 in the lower mandrel member 26.

When the window element 43 is positioned in the aligned windows or openings 28 and 33 in respectively the lower mandrel 26 and the inner mandrel 32, with the latter disposed in telescoped condition in the lower mandrel (FIG. 4), cap bolts 50 (FIG. 4) are adapted to be received through passageways 48 and aligned threaded openings 30, and into threaded coaction with the respective threaded opening 34 in the inner mandrel 32, thus securely attaching the window element 43 in the window opening 28 in lower mandrel 26 and in window opening 33 in inner mandrel 32. The rear side of window element 43 is preferably provided with a generally rectilinear (in plan—FIG. 14)) shoulder 52 thereon which is preferably received through the opening 33 in the inner mandrel 32 to project slightly into the passageway 54 though the inner mandrel, and as can be best seen in FIG. 4. The concave sections 52*a* are adapted for slip fit coaction with the frontal generally cylindrical surface 55 of the eccentric portion 67 of the notch gun 56 (FIGS. 4, 16, 17, 18) when the notch gun is being moved downwardly into operative position in the inner mandrel, and as will be hereinafter described in greater detail. Aforementioned openings 31 in lower mandrel 26 are adapted to receive welds for securely attaching inner mandrel 32 in telescoped, fastened condition in lower mandrel 26.

Figure 4:
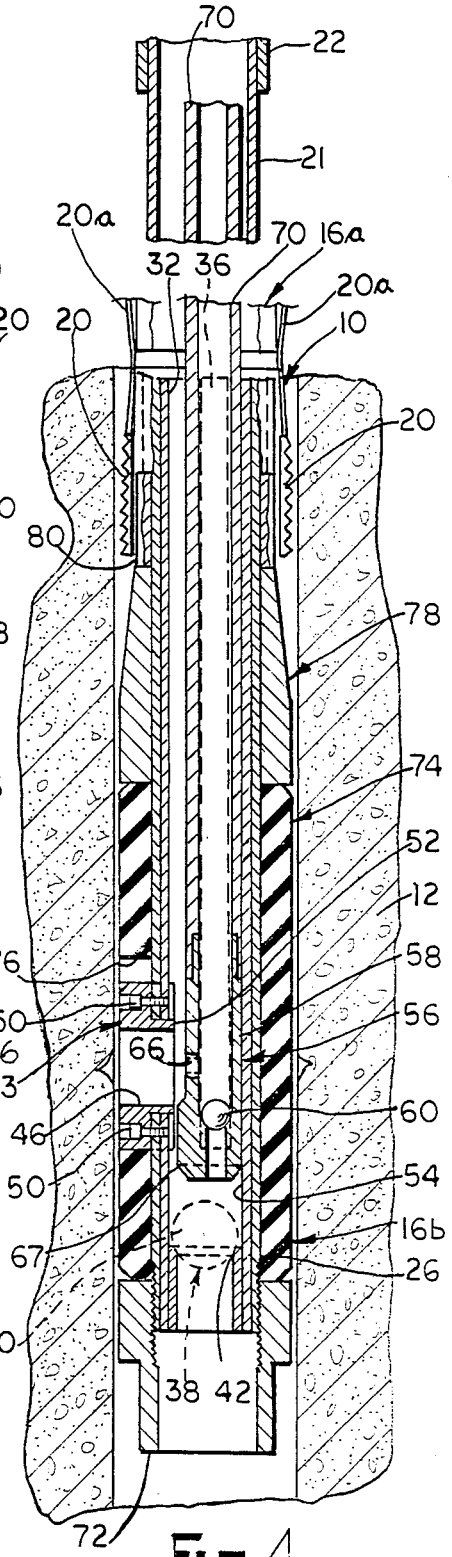
FIG. 4 is a sectional view of the packer assembly of FIG. 3 taken generally along section line 4—4 of FIG. 3, looking in the direction of the arrows.
Figure 17:
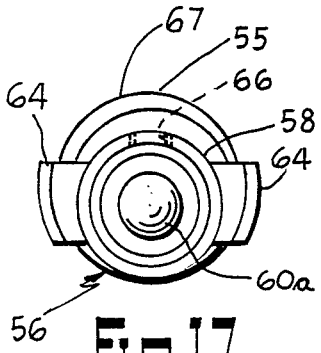
FIG. 17 is an end view of the notch gun of FIG. 16 taken from the left hand end thereof, and showing the ball-type check valve assembly in the bottom thereof.
Figure 16:
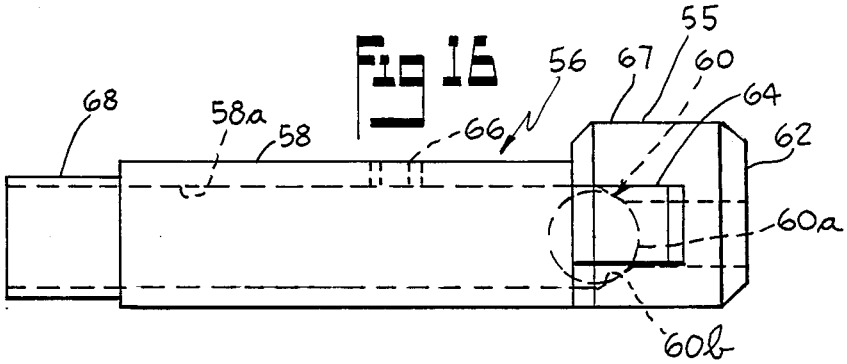
FIG. 16 is a side elevational view of the notch gun shown in the FIGS. 3 and 4 packer assembly; the notch gun has been rotated 90 degrees from its usual vertical position in the well bore.
Figure 18:
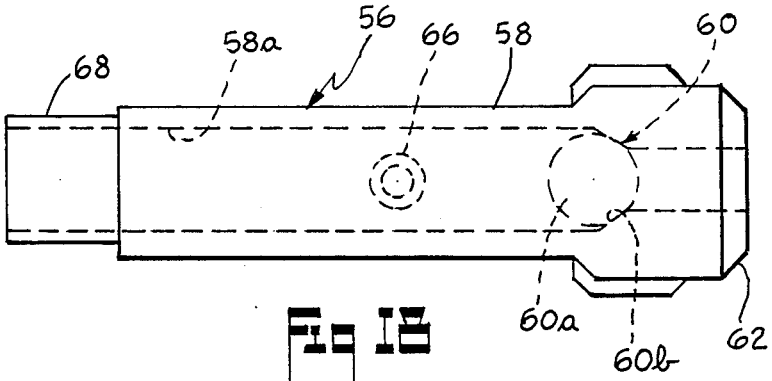
FIG. 18 is a rear elevational view of the notch gun of FIG. 16.

Referring now particularly to FIGS. 16–18 in conjunction with FIG. 4, it will be seen that the notch gun in the embodiment illustrated, comprises a head 58 having a lengthwise passageway 58*a* extending therethrough, and with the lower end of the passageway being provided with a check valve 60, comprising in the embodiment illustrated a valve ball member 60*a* adapted for seating engagement with a valve seat 60*b* formed in the head of the gun, for preventing or resisting the passage of fluid out the lower end 62 of the notch gun. Check valve 60 is preferably heat treated and nitrided similarly as that of check valve 38. Ball 60*a* may also be formed of suitable materials other than metallic. Projecting laterally from the head portion 58 of gun 56 are a pair of wings 64, each of which is adapted to be received in guided coaction with a respective one of the aforementioned slots 36 in the sides of the inner mandrel member 32, thus guiding the movement of the gun lengthwise of the inner mandrel and until the wings 64 on the notch gun engage the aforementioned terminal ends 36*a* of slots 36.

The notch gun 56 is provided with a preferably iron carbide jet orifice 66 therein communicating with the aforementioned passageway 58*a* in the gun, for passage therethrough of notching fluid in jet stream form when the gun is in operative position in the packer assembly as shown for instance, in FIG. 4, but with the sealing element of the packer actuated or expanded outwardly into sealing relation with the bore 10, rather than the deactuated condition of packer illustrated. The aforementioned eccentric portion 67 on the lower end of the gun projects in the same general direction as the direction of the extension of orifice 66.

The upper end of the gun may be provided with a threaded portion 68 adapted to be connected to gun conduit line 70 (FIG. 4) extending upwardly from the gun to the surface of the ground and operative for raising and lowering the gun in pipe string 18, and controlling the positioning of the gun in the packer assembly, and also for furnishing notching fluid via line 70 to the gun when it is desired to notch a selected zone in the bore hole, and as will be hereinafter described in greater detail, Any other suitable means may be used to connect gun 56 to line 70, such as for instance welding.

From FIG. 4, it will be seen that when the notch gun is in operative lowermost position in the packer assembly, the aforementioned orifice 66 in the gun is generally centrally aligned with the horizontal axis of the opening 46 in window element 43, and the axes of openings 28 and 33, in respectively the lower mandrel 26 and coacting inner mandrel 32 of the packer assembly, so that application of pressurized notching fluid via line 70 to the gun, will cause the notching fluid to stream or spurt laterally through the aforementioned window element 43 and coacting openings in the packer tool assembly to apply the notching fluid in jet stream form to the well bore periphery at the selected zone thereof. The aforementioned check valve 60 at the lower end 62 of the gun prevents the notching fluid from flowing out such lower end, and forces it to exit at jet port 66.

Referring again to FIG. 4, it will be seen that the eccentric portion 67 of the gun insures that the gun body 58 and orifice 66 therein will be spaced from the inwardly projecting shoulder 52 on the window element, so that pressurized notching fluid being supplied by the gun to the opening in the window element during a notching operation can escape back upwardly between the gun and the window element into the inner mandrel.

Figure 5:
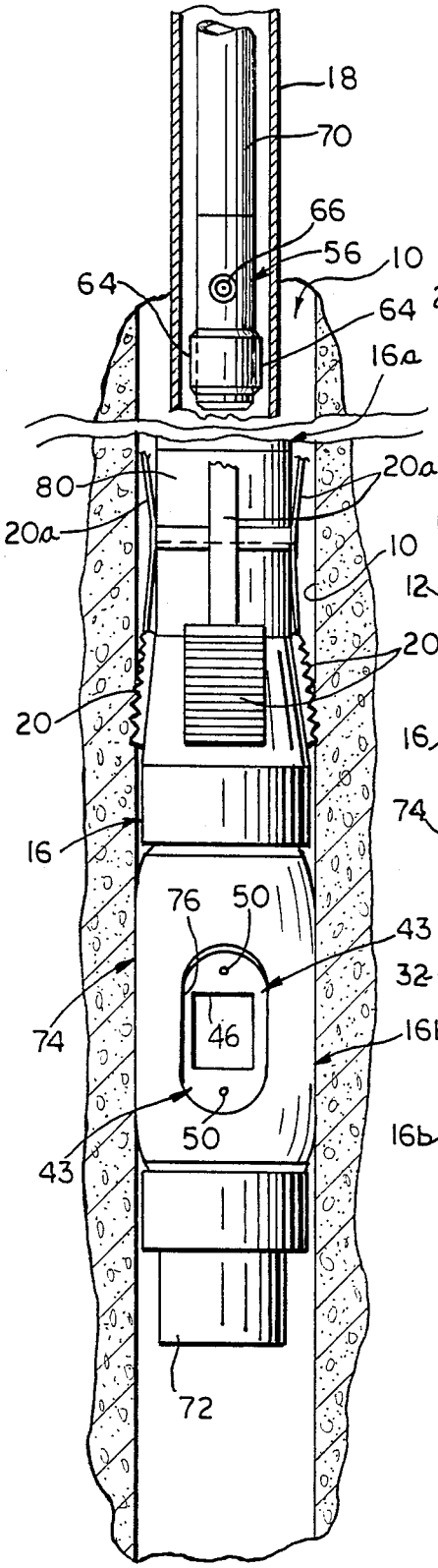
FIG. 5 is a view generally similar to FIG. 3 but showing the packer in actuated or set condition and with the sealing element thereof forced into sealing relation with the interior of the well bore, and with the notch gun of FIGS. 3 and 4 having been raised out of the packer to be disposed in the upper reaches of the conduit or pipe string attached to the packer.
Figure 3:
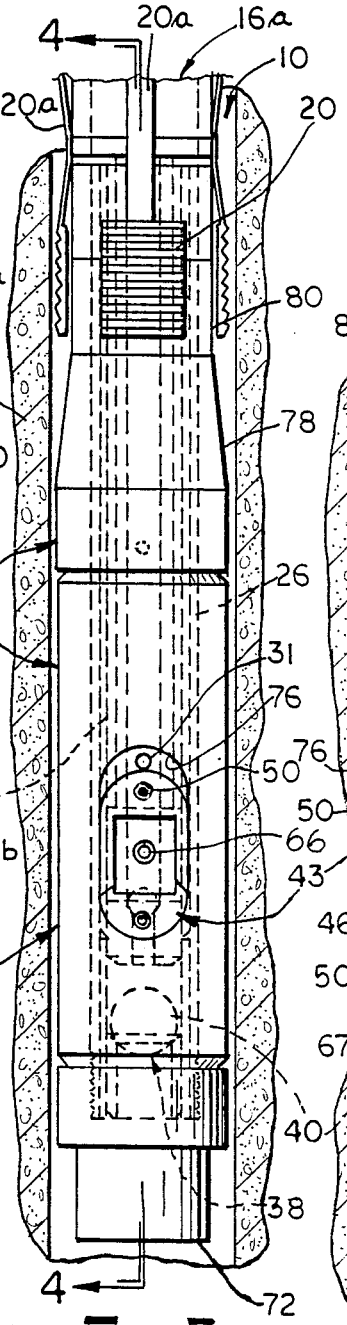
FIG. 3 is a enlarged elevational view of the packer assembly of the invention including the sealing element of the packer and the window opening therethrough and which is attached to a conventional upper section of a slip type packer disposed in a well bore, and with a notch gun being disposed in operating notching position in the packer; in this view the sealing element of the packer is shown in deactuated condition.
Figure 15:
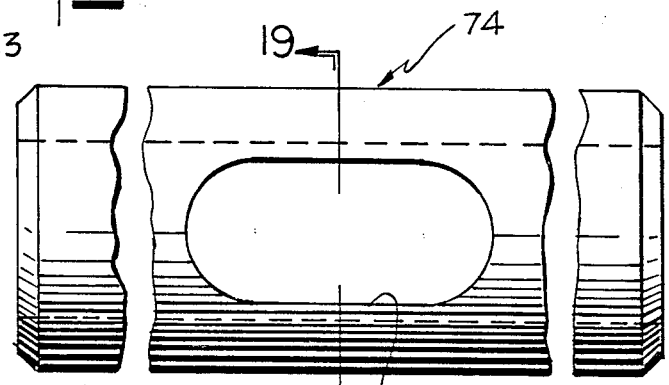
FIG. 15 is a broken, front elevational view of the sealing member of the packer assembly, such sealing member being adapted to receive lengthwise therethrough the lower mandrel of FIG. 6, and with such sealing member having been rotated 90 degrees from its usual vertical position in the packer assembly when the latter is in use in a well bore.
Figure 14:
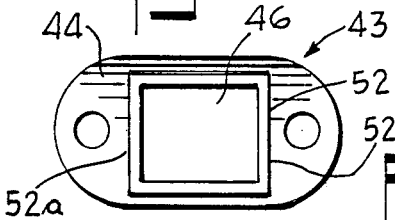
FIG. 14 is a rear elevational view of the window member of FIG. 11.
Figure 19:
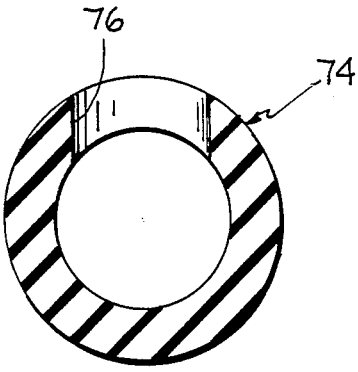
FIG. 19 is a sectional view taken generally along the plane of line 19—19 of FIG. 15, looking in the direction of the arrows, and showing the lateral opening in the sealing element which is adapted to receive therethrough the window element of FIGS. 11–14.

Encircling the exterior of the lower mandrel 26 and disposed between a nut member 72 (FIGS. 3, 4 AND 5) which is preferably threaded to the lower threaded end 26*a* of the lower mandrel 26, is an elongated sealing member 74 (FIGS. 15 and 19). Member 74 is formed of flexible resilient material, such as for instance, rubber, and in accordance with the invention is provided with an opening 76 therethrough of preferably elongated generally elliptical like configuration, with said opening receiving the window element 43 therein, with the latter thus being disposed in encompassed relation by the sealing member 74 mounted on the exterior of the lower mandrel 26, and as best illustrated in FIGS. 3 and 5. The sealing element in certain instances when formed of rubber preferably has a Shore durometer of approximately 45 to 50 and in other instances may have a Shore durometer of approximately 85 to 90, and as will be hereinafter described in greater detail.

Referring now again to FIG. 4, it will be seen that sealing member 74 is disposed in generally snug and encircling relationship to the lower mandrel 26 with the opening or window 76 therein generally aligned with the window element 43 mounted on and attached to the lower and inner mandrels 26 and 32. The aforementioned nut 72 threaded onto the lower end of the lower mandrel 26, is adapted to generally abut the lower end of the sealing member and the upper end of the sealing member adapted to be abutted by the tapered cone member 78 of the lower mandrel assembly 16*b*. Cone member 78 is of conventional known construction and operation. Disposed above the tapered cone 78 may be a spacer member 80 encircling in slip fit relation the upper end portion of the lower mandrel 26, with the upper threaded end portion 26*a* of the lower mandrel then being secured in threaded coaction with the back off bushing of the packer upper section 16*a*, thus connecting the lower mandrel 26 to the upper mandrel 21 of the upper packer assembly 16*a*. The upper mandrel passes movably through the the conventional cage of the packer and may be attached by aforementioned collar 22 to the conventional pipe string 18 which is used for lowering and raising the packer in the well bore, for setting and unsetting the packer, and for supplying fracturing fluid to the packer, and thence via the window element 43, to the confronting periphery of the well bore.

METHOD OF FRACTURING

The method of fracturing a non-lined or non-cased well bore may be as follows. The packer embodying the invention as aforedescribed, is lowered down into a drilled well bore to a selected oil or gas bearing zone which has been previously determined utilizing conventional electronic logging devices which determine the depth and thickness of the oil and gas bearing sandstone. The packer is actuated in the conventional manner by moving the lower mandrel 26 (and attached inner mandrel 32) and attached lower end nut 72 upwardly against the underside of the sealing element 74 and in the conventional manner utilizing the conventional J-slot and control mechanism for so moving the lower mandrel, such action causing the slips 20 coacting with the tapered cone 78 to move or swing outwardly into anchoring engagement with the confronting periphery of the well bore.

Further upward movement of the nut 72 and lower mandrel 26 causes the sealing element 74 to bulge outwardly into sealing relationship with the confronting periphery of the well bore at the selected zone and as illustrated in FIG. 5. Thereafter, fracturing fluid may be pumped, via the aforementioned pipe string line 18, downwardly to the packer, with the check valve 38 preventing flow of the fracturing fluid out the lower end of the packer tool 16, and instead causing the fracturing fluid to pass via the openings 33, 28 and 46 in respectively the inner mandrel 32, the lower mandrel 26, and the window element 43, into high pressure engagement with the confronting area of the zone of the formation facing the window element. In the embodiment illustrated, opening 46 in window element 43 may be approximately 2 inches wide by approximately $2\frac{1}{2}$ inches high.

Figure 2:
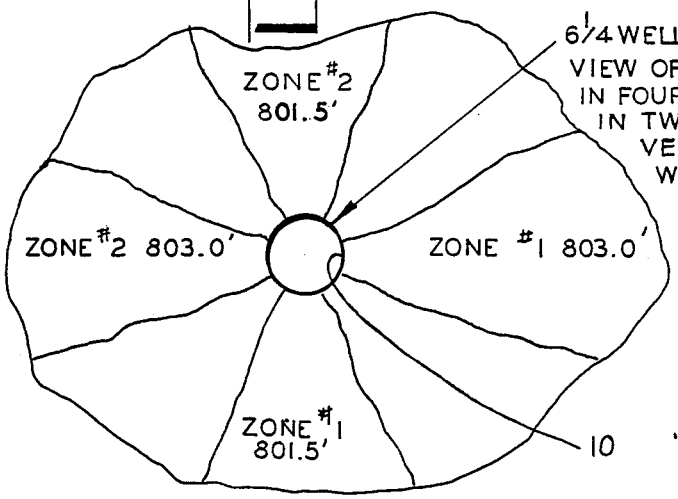
FIG. 2 is a diagrammatic plan view of a well bore illustrating directional application of fracturing fluid to a well bore utilizing the packer and method of the invention, so that fracturing can occur extending outwardly from the well bore at a plurality of packer rotative positions, thereby increasing the fracturing of the formation and thereby increasing the flow of gas and oil from the fracturing process into the well bore.

A pressure of for instance about 2500 to about 4000 pounds per square inch fluid pressure may be applied to the confronting area of the formation at the window element and has been generally found adequate and usually capable of causing fracturing of the confronting zone, with such fracturing as illustrated in FIG. 2, progressing generally radially outwardly from the well bore. When the formation breaks, water with a mixture of grit may then be pumped down the pipe string 18 to the fracture to aid in holding the fracture "open", thus facilitating the seepage of any gas and oil from the fracture into the well bore.

With the packer of the invention, it will be seen that the fracturing fluid may be expeditiously directionally controlled for fracturing the formation. After the first fracturing at for instance zone #1 at for example 803 feet, the packer tool may then be deactuated by moving the upper mandrel 21 and attached lower mandrel 26 and nut 72 downwardly relative to the slips 20, and the sealing element 74 to free up the sealing engagement of the sealing element with the confronting well bore, after which the packer tool can be rotated, say for instance 180 degrees to face in the direction of zone #2 at the specified depth of 803 feet, and then the packer tool is reactuated into sealing engagement with the well bore, after which the process is repeated for applying fracturing fluid through the pipe string line 18 down to the packer and laterally thereof through the window element 43 into fracturing engagement with the zone of the formation to cause directional fracturing of zone #2 in a direction 180 degrees removed from the first fracturing operation, and as diagrammatically illustrated in FIGS. 1 and 2 and identified as zones 1 and 2 at 803 foot depth.

Thereafter, the packer tool can be again deacuated and preferably moved slightly upwardly or downwardly in the well bore to space the packer window element slightly from the first fractured zones 1 and 2 at the 803 foot depth, and then upon reactuation of the packer element in a direction 90 degrees removed from either of the first fractured 803 foot depth zones 1 and 2, the confronting zone of the formation can be fractured as illustrated in FIG. 2 at zone 1 at a depth of for instance 801.5 feet, after which the packer can be deactuated, rotated 180 degrees with respect to the fractured zone No. 1 at 801.5 foot depth, and repressurized whereupon fracturing of the confronting zone identified as zone number 2 at the 801.5 foot depth can be accomplished. Thus, it will be seen that four fractures can be provided in four different directions within a one and a half to two feet vertical range of one another.

The packer tool can then be deactuated, moved upwardly a selected number of feet in the well bore and then reset to again fracture the zones of the formation disposed in confronting relationship to the sealing element of the packer. In this way, substantially more fracturing of a formation can occur and such fracturing can be more precisely controlled due to the directional orientation of the fracturing responsive to the selected rotative position of the packer tool and particularly the position of the lateral opening in the sealing element of the packer tool.

Also in connection with the fracturing of the zones, the notch gun 56 as shown in FIG. 4, can be first positioned with the packer tool 16 at selected locations vertically in the well bore, and notching fluid can be applied via the notch gun supporting pipe line 70 to the gun, whereupon the pressurized notching fluid is directed laterally outwardly through the orifice 66 therein into notching engagement with the confronting well bore surface, thus notching such surface at the selected zone and facilitating the subsequent fracturing thereof. During such notching operation the packer is set and the sealing element thereof actuated.

After accomplishment of the notching of the well bore in the selected zone, the notch gun 56 can be raised up by means of pipe line 70, in the pipe string 18 to a position above the packer tool and as illustrated in FIG. 5, and then fracturing fluid can be applied via the packer tool to the notched location to cause fracturing of the confronting zone.

With prior art fracturing methods, the amount of fractures able to be performed largely depends on the length of the packer mechanism or tool which is being used. When fracturing the formation from the top on down in a formed well bore, which may be considered normal practice, there must always be room available above the intended zone to be fractured for the packer sealing device and the spring slips, and cone which are the setting device for the packer. The space heretofore conventionally needed for a pressure packer to properly operate is between three and one-half to four feet above each intended fracture. For example, if the oil and gas bearing sandstone formation is about 30 feet thick, there is room for approximately seven or eight fractures in such 30 foot thick zone.

By utilizing the pressure packer tool of this invention, and associated method, the fracturing of the formation can be directed in the direction that it is desired that it go. Also, it is possible to fracture from the bottom of the well bore up and notch each zone at the time just prior to fracturing them instead of notching the entire formation first and then going back and fracturing the formation at the notches. Utilizing the tool and method of this invention, the well bore can be fractured generally at approximately one to two feet levels instead of three and one-half to four feet levels. By notching one zone at a time and fracturing from the bottom of the well bore up, there is no fear of the slips of the packer getting caught in the notches above the packer because there will be no notches; furthermore, an more, an artificial bottom as is conventionally utilized as heretofore discussed, is not needed with the packer arrangement of this invention.

Once the packer tool is set at a level in the well bore, the latter can be notched if needed, and then that side of the well bore may be fractured, after which the packer tool can be turned 180 degrees , the packer reset, the formation notched, if needed, and then again fractured. It will be seen therefore that two fractures may be made at the same general level in the well bore.

The packer can then be moved slightly up the well bore about one and one-half feet, for instance, and turned 90 degrees from its last setting, and then after "setting" the packer and notching the formation, the formation can be fractured. The packer can then be released, turned 180 degrees, and "set" again. Notching can then be accomplished if needed and fracturing of the formation accomplished in in this new direction. What has happened in such well bore is that it has been fractured four times in four different directions within an approximately one and a half to two foot section of the formation, and the direction of the fracturing has been precisely controlled.

It will be seen that providing the check valve 60 in the lower end of the notching gun 56 and the check valve 38 in the lower end of the inner mandrel 36 enables fluid to be pumped around the pipe string 18 to beneath the packer tool, up through the bottom of the hollow nut 72, and lift the ball member 40 of the check valve 38 upwardly, thereby reversing the flow of fluid through the the lower packer assembly, to clear obstructions therein. The same holds true for the notch gun wherein the fluid can flow up through the open bottom of the gun and lift the ball **60*a* of the check valve 60 upwardly away from its seat 60*b* to aid in clearing obstructions in the lengthwise extending passageway 58*a*** therein.

While the invention has been described in connection with oil or gas wells and methods of fracturing thereof, it is also useable with other types of wells, such as for instance the drilling of water wells.

Referring to FIG. 3, it will be seen that in the noncompressed or deactuated condition of the sealing element 74 of the packer tool, the lengthwise opening 76 in the sealling element is longer than the lengthwise dimension of the window member 43, which is attached to the lower mandrel 26 and encompassed by the sealing element. The purpose of such is that the sealing element material moves around the window element when the packer is "set" or actuated to accomplish a good sealing of the resilient material of the sealing element with the periphery of the well bore, together with accomplishment of a nonleaking relationship between the sealing element and the lower mandrel 26 about the window member 43.

The following are examples of test results which were the result of tests made on a $5\frac{7}{8}$ inch exterior diameter, 85 to 90 Shore durometer rubber sealing element and on a $5\frac{3}{4}$ inch exterior diamater, 45 to 50 Shore durometer rubber sealing element each disposed within a six and one-fourth inch diameter test pipe, with such testing showing the pounds of force or compression applied, the measured inches that the sealing element material pushed together for each respective force application, and the measured gaps between the sealing element and at both the top and bottom of the associated window member 43 at the respective application of force.

TEST RESULTS

| Pounds | Inches | Top | Bottom |
|---|---|---|---|
| $5\frac{7}{8}$" 85-90 Durometer | | Gap at Window | |
| 0 | 0 | 15/16" | 0 |
| 3,000 | $1\frac{3}{8}$" | 0 | 0 |
| 5,000 | 1 9/16" | 0 | 1/32" |
| 10,000 | $1\frac{3}{4}$" | 0 | $\frac{1}{8}$" |
| 15,000 | 1 15/16" | 0 | 3/16" |
| 20,000 | 1 15/16" | 0 | 3/16" |
| $5\frac{3}{4}$" 45-50 Durometer | | Gap at Window | |
| 0 | 0 | 13/16" | 0 |
| 1,500 | 1" | 0 | 0 |
| 5,000 | $2\frac{3}{8}$" | 0 | 1/16" |
| 10,000 | $2\frac{5}{8}$" | 0 | 3/16" |
| 15,000 | $2\frac{3}{4}$" | 0 | 3/16" |
| 20,000 | 2 13/16" | 0 | $\frac{1}{4}$" |

From such tests, it was determined that the proper "setting" pressure for the tool of the invention when utilizing a rubber sealing element as shown, to be preferably approximately 10,000 pounds. The rubber sealing member from the above group which "set" the best and adapted in best sealing relation to the window element 43, in applicant's view was the $5\frac{3}{4}$ inch external diameter sealing member with a 45 to 50 Shore durometer hardness. While that type is preferred, other types as is indicated, are workable with the packer tool of this invention.

From the foregoing discussion and accompanying drawings, it will be seen that the invention provides a novel packer tool for use in a well bore, with such packer tool having a laterally extending opening therethrough for applying fracturing fluid from a source thereto to the packer assembly and then in a direction laterally thereof into fracturing contact with a selected zone of the formation traversed by the well. The invention also provides a notch gun which is adapted to be guided by an inner mandrel of the packer assembly, and positioned in guided relation in the packer tool, for notching the confronting areas of the formation.

The invention also provides a novel method of fracturing a well whereby more precise control over the application of fracturing liquid and/or the notching liquid, to the periphery of the well is accomplished, resulting in the ability to fracture more areas of the formation of a well thereby enhancing the flow of oil and/or gas into the well bore for recovery.

The invention also provides a lower packer assembly section which is adaptable for ready connection to an upper packer assembly section of a conventional packer, and which provides the aforementioned directional control of fracturing and notching.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

I claim:

1. A method of fracturing a formation traversed by a well comprising providing a packer and attached piping, with said packer including a deformable sealing member having ends and having a lateral opening therethrough intermediate said ends and communicating with said piping via such packer, said opening being disposed along an axis generally traverse to the lengthwise axis of said packer and piping, positioning the packer in said well at a selected zone in said formation and actuating said packer to cause application of compressive force to said sealing member from an exterior end thereof thus causing deformation of said sealing member into pressurized sealing engagement with the interior periphery of said well, pumping a fracturing fluid to said zone via said piping and said opening and at a pressure in excess of the breakdown pressure of the formation whereby the fracturing fluid is directionally applied via said opening laterally into engagement with said zone at said opening in the compressively deformed sealing member to fracture said formation at said zone commencing at said opening and extending outwardly therefrom.

2. A method in accordance with claim 1 including lowering a notching gun through said piping to said zone and notching said zone with said gun via said opening in said packer prior to application of the fracturing fluid via said piping and said opening to said zone.

3. A method in accordance with claim 1 including deactuating said packer after said fracturing of said formation at said zone, rotating said deactuated packer a predetermined amount about said lengthwise axis and relative to said fractured portion of said zone whereby said opening faces a different section of the periphery of said well at said zone, reactuating said packer into set pressurized engagement of said sealing member with the periphery of said well, and introducing further fracturing fluid via said piping to said packer and said opening therein, to fracture said formation commencing at said opening and extending outwardly therefrom in a direction different from the direction of fracturing of the first mentioned fracturing activity.

4. A method in accordance with claim 1 including fracturing at vertically spaced locations in said well, of formations traversed by said well, by vertically moving said packer selectively into active set coaction with a selected zone and fracturing that selected zone via said opening, and then deactuating the packer and moving it upwardly or downwardly vertically in said well to the next selected zone, resetting the packer at the last mentioned zone, and then fracturing that zone via said opening.

5. A method in accordance with claim 1 including the step of lowering a notching gun through said piping to said zone and notching said well with said gun via said packer opening at a selected zone location in said well, and prior to application of the pressurized fracturing fluid to said zone at said opening, deactuating said packer after said fracturing, rotating said deactuated packer about said lengthwise axis and relative to said fractured portion of said zone whereby said opening and said gun faces a different section of the periphery of said well at said zone, reactuating said packer into set pressurized engagement of said sealing member with the well, and notching said zone with said gun in a direction different from the first mentioned direction of fracturing prior to application of further fracturing fluid to said opening.

6. A method in accordance with claim 1 including providing a check valve on the lower end of the packer to enable reverse flow of fluid from beneath the packer up through the packer, but preventing fluid flow from interiorly of said packer in the reverse direction, and including the step of applying fluid to the well bore past the packer in the deactuated condition of the latter and to the underside thereof to cause said reverse flow of fluid from beneath the packer up through the packer.

7. A pressure packer assembly including a lower mandrel section adapted to be secured to an upper lengthwise movable portion of the packer, said lower mandrel section having a deformable sealing element mounted thereon adapted when set to prevent fluid flow from below said packer assembly to above said sealing element, said sealing element having ends, said lower mandrel section including means for selectively causing application of compressive force to said sealing element from an external end thereof to thus cause deformation of said sealing element to cause said setting thereof, said mandrel section having a lateral opening therethrough and said sealing element having a lateral opening therethrough intermediate said ends and in general alignment with the first mentioned opening, and a window element secured to said mandrel section at said opening in said sealing element, said window element being generally encompassed by said sealing element and adapted to pass pressurized fracturing fluid therethrough being supplied downwardly through said lower mandrel section and then laterally through said mandrel opening, said window element and encompassing sealing element opening in said set sealing condition of said sealing element and thence into fracturing contact with the confronting well bore at said window element.

8. A packer assembly in accordance with claim 7 wherein said lower mandrel section at its lower end includes an upwardly opening check valve disposed on said lower mandrel section end for restricting passage of fracturing fluid downwardly out of said end of said lower mandrel section.

9. A packer assembly in accordance with claim 7 wherein said lower mandrel section is threaded at a distal end for threaded coupling to the upper portion of the packer, the lower end of said lower mandrel section being threaded and also including a nut coacting in threaded coaction with said threaded lower end of said lower mandrel section and maintaining said sealing element in assembled but removable relationship with said lower mandrel section, said nut also comprising said means for selectively causing application of compressive force to said sealing element from an end thereof during upward movement of said nut and lower mandrel section relative to said sealing element upon said setting of said sealing element.

10. A packer assembly in accordance with claim 7 wherein said opening in said sealing element is of a greater height dimension as compared to the corresponding dimension of said window element whereby said sealing element upon setting of said packer is expanded outwardly into sealing relationship with the well bore periphery without interference with said window element.

11. A pressure packer assembly including a lower mandrel section adapted to be secured to an upper lengthwise movable portion of the packer, said lower mandrel section having a deformable sealing element mounted thereon adapted when set to prevent fluid flow from below said packer assembly to above said sealing element, said mandrel section having a lateral opening therethrough and said sealing element having a lateral opening therethrough in general alignment with the first mentioned opening, and a window element secured to said mandrel section at said opening in said sealing element, said window element being generally encompassed by said sealing element and adapted to pass pressurized fracturing fluid therethrough being supplied downwardly through said lower mandrel section and then laterally through said mandrel opening and encompassing sealing element opening and into fracturing contact with the confronting well bore at said window element, and including an inner mandrel mounted interiorly of said lower mandrel section and having means thereon for guiding coaction with respect to an elongated notching gun insertable lengthwise of the packer and into said inner mandrel, and means on said notching gun adapted for coacting in guided relationship with respect to said means on said inner mandrel for guiding the lengthwise movement of said notching gun relative to said inner mandrel to an operative position therein, said inner mandrel having a lateral opening therein generally aligned with said lateral opening in said lower mandrel section, said notching gun being adapted to notch the confronting well bore at said window element via the latter and said mandrel openings.

12. A packer assembly in accordance with claim 11 wherein said notching gun has a hardened orifice directed laterally and communicating with the hollow interior of said gun, with said orifice of said gun being positionable responsive to lengthwise positioning movement of said gun into alignment with said openings in said lower mandrel section and said inner mandrel and with said window element, for applying notching fluid to the confronting interior surface of the well bore when so positioned.

13. A packer assembly in accordance with claim 7 wherein said sealing element consists of a tubular rubber member having a Shore durometer of approximately 45–50.

14. A packer assembly in accordance with claim 7 wherein said sealing element consists of a tubular rubber member encompassing said lower mandrel section in generally snug relation and having a Shore durometer of approximately 85–90.

15. A packer assembly in accordance with claim 7 wherein there is substantially zero clearance between said window element and the upper end of the opening in said sealing element of the packer upon said setting of the packer.

16. A packer assembly in accordance with claim 7 wherein said sealing element opening has a greater height dimension than the corresponding dimension of said window element, said sealing element being caused to be compressed in the lengthwise direction and from said end thereof upon said setting of the packer assembly by said means utilizing a compression force of approximately 10,000 pounds, said sealing element being formed on rubber and having a Shore durometer of approximately 85–90.

17. A packer assembly in accordance with claim 7 wherein said sealing element is caused to be compressed in the lengthwise direction thereof during said setting of the packer assembly, said sealing element being formed of rubber and having a Shore durometer of approximately 45–50, said sealing element opening in the deactuated condition of said packer being of a greater height dimension as compared to the corresponding dimension of said window element.

18. In a pressure packer assembly, a lower mandrel section adapted to be secured to an upper lengthwise movable portion of the packer, a sealing element mounted on said lower mandrel section, said sealing element comprising an elongated deformable tubular-like member receiving therethrough said lower mandrel section in generally snug relation therewith and adapted for sealing engagement with the confronting peripheral surface of the well bore upon actuation of said packer, said lower mandrel section including means for selectively causing application of compressive force to said sealing element from an external end thereof thus causing deformation of said sealing element into said sealing engagement with the confronting peripheral surface of the well bore during said actuation of the packer, said sealing element and said mandrel section each having a lateral opening therethrough disposed in generally aligned relation relative to one another, said openings adapted to pass fracturing fluid therethrough passing downwardly to said packer and then laterally through said openings into fracturing contact with a confronting well bore in the actuated condition of the packer and associated deformed sealing condition of said sealing element.

19. A packer assembly in accordance with claim 11 wherein said gun includes an orifice directed laterally and commnicating with the hollow interior of said gun, said gun being adapted for disposal so that said gun orifice is disposed in generally confronting relation to the opening through said window element, and means on said gun coacting with said inner mandrel for maintaining spacing between said window element and said gun whereby notching fluid being applied to said opening in said window element by said gun can escape from said window element and flow in said inner mandrel between said window element and said gun.

20. A packer assembly in accordance with claim 19 wherein said means on said gun includes an eccentric portion extending in the direction of extension of said gun orifice to space the orifice portion of said gun from said window element.

21. In a pressure packer assembly in accordance with claim 18 including a window element secured to the exterior side of said mandrel section about said opening therethrough and extending laterally into said opening in said sealing element whereby said sealing element encompasses said window element, the fracturing fluid in the actuated condition of the packer being adapted to pass through said window element into fracturing contact with the confronting well bore while being constrained from radial movement away from the window element by said sealing engagement of the deformed sealing element with the peripheral surface of the well bore about said opening in said sealing element.

* * * * *